US006060653A

United States Patent [19]

Willis

[11] Patent Number: 6,060,653

[45] Date of Patent: May 9, 2000

[54] METHOD AND APPARATUS FOR ADJUSTING KEYS OF A MUSICAL KEYBOARD INSTRUMENT FROM A WEIGHTED ACTION TO SYNTHESIZER FEEL

[76] Inventor: Raymon A. Willis, 304 Woodbine Rd., Savannah, Ga. 31410

[21] Appl. No.: 09/322,015

[22] Filed: May 28, 1999

Related U.S. Application Data

[60] Provisional application No. 60/087,347, May 29, 1998.

[51] Int. Cl.[7] ..... G10C 3/12

[52] U.S. Cl. ..... 84/433; 84/423 R; 84/439

[58] Field of Search ..... 84/433, 432, 439, 84/440, 423 R

[56] References Cited

U.S. PATENT DOCUMENTS 4,993,305 2/1991 Franz et al. ..... 84/439

*Primary Examiner*—Robert E. Nappi
*Assistant Examiner*—Shih-yung Hsieh
*Attorney, Agent, or Firm*—Jim Zegeer

[57] ABSTRACT

A musical keyboard instrument (EM1) keyboard which has a plurality of keys, a common pivot point for said keys and a spring biases each key to a uniform position, each key having an associated weight member and a common fulcrum point for each associated weight member, and each key having a dependent weight actuator member engaging its associated weight member, respectively, such that when a key is depressed by a musician the "feel" to the musician is that of a given type of keyboard instrument. A device for disabling the effect of at least some of said associated weight members changes the "feel" to the musician of the keyboard. The device for disabling includes a bar member pivotally mounted to the instrument frame and beneath the associated weight members and a device for rotating the bar member in a direction to rotate the associated weight members about the common fulcrum point and disengage the weight actuator members from engagement with the associated weight member.

2 Claims, 4 Drawing Sheets

METHOD AND APPARATUS FOR ADJUSTING KEYS OF A MUSICAL KEYBOARD INSTRUMENT FROM A WEIGHTED ACTION TO SYNTHESIZER FEEL

REFERENCE TO RELATED APPLICATION

This application is the subject of provisional application Serial No. 60/087,347 filed May 29, 1998 and entitled METHOD AND APPARATUS FOR ADJUSTING KEYS OF A MUSICAL KEYBOARD INSTRUMENT FROM A WEIGHTED ACTION TO SYNTHESIZER FEEL.

BACKGROUND AND BRIEF DESCRIPTION OF THE INVENTION

The object of the invention is to provide a method and apparatus for adjusting the "feel" to a musician of a weighted action keyboard to synthesizer "feel."

A musical key block assembly having a plurality of keys, each key is pivotally mounted for actuation about a pivot and biased to a normal at rest position. Key actuation sensor strips can be positioned above or below the keys to sense key actuation and expression effects and provide electrical signals for MIDI processing. Key weight members are associated with each key and are pivotally mounted or fulcrumed on a common pivot member and engaged by a key stem extending from its associated key so that depression or playing of a key by a musician causes the stem to engage its respective key weight and pivot the weight about the common pivot. The key weights are designed to provide the normal "piano feel" to the musician. In order to modify the "feel", according to the invention, a bar member is hingedly mounted adjacent all or a selected number of the key weights so that when the bar member is pivoted about its hinge axis, it pivots all or the selected number of key weights to a position where the respective key stems do not engage the respective key weight member and thereby change the feel from a regular piano weighted feel to the "feel" of a synthesizer.

Some musicians do not desire the weighted feel for base notes. In this case, the bar member is adapted to affect only base note keys.

Felt or rubber padding is on the surface of the bar member for silencing. The bar member may be operated to different positions of adjustment by a wheel(s) or by a lever(s) positioned at the end(s) of the keyblock assembly. While manual adjustment of the bar member is preferred, it will be appreciated the weight adjustment bar member can be operated by a small electric motor or solenoid controlled by a switch.

DESCRIPTION OF THE DRAWINGS

The above and other objects, advantages and features of the invention will become more apparent when considered with the following specification and the attached drawings, wherein.

DETAILED DESCRIPTION OF THE INVENTION

Figure 1:
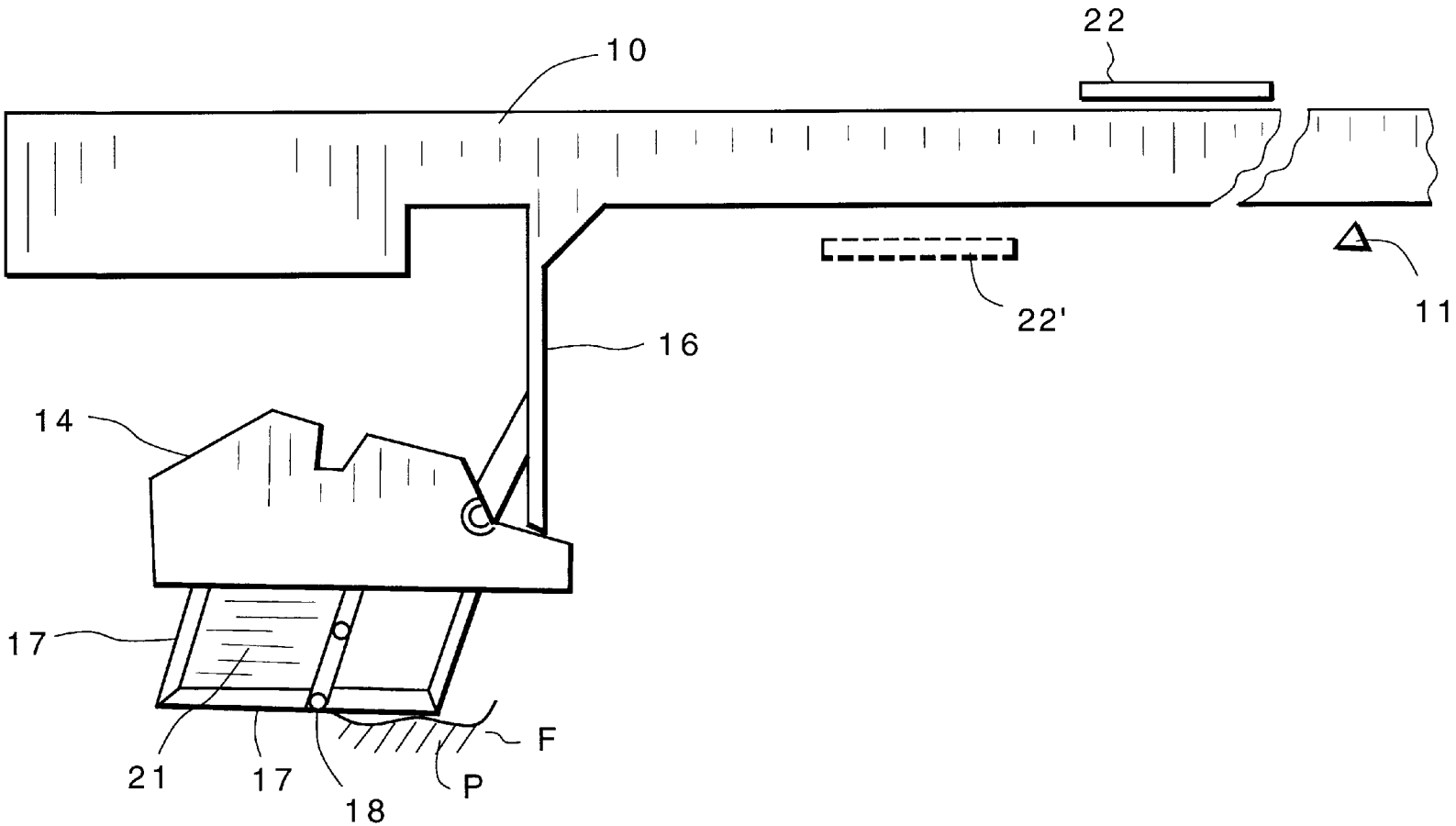
FIG. 1 is a side elevational view of a weighted key block assembly incorporating the invention.
Figure 2:
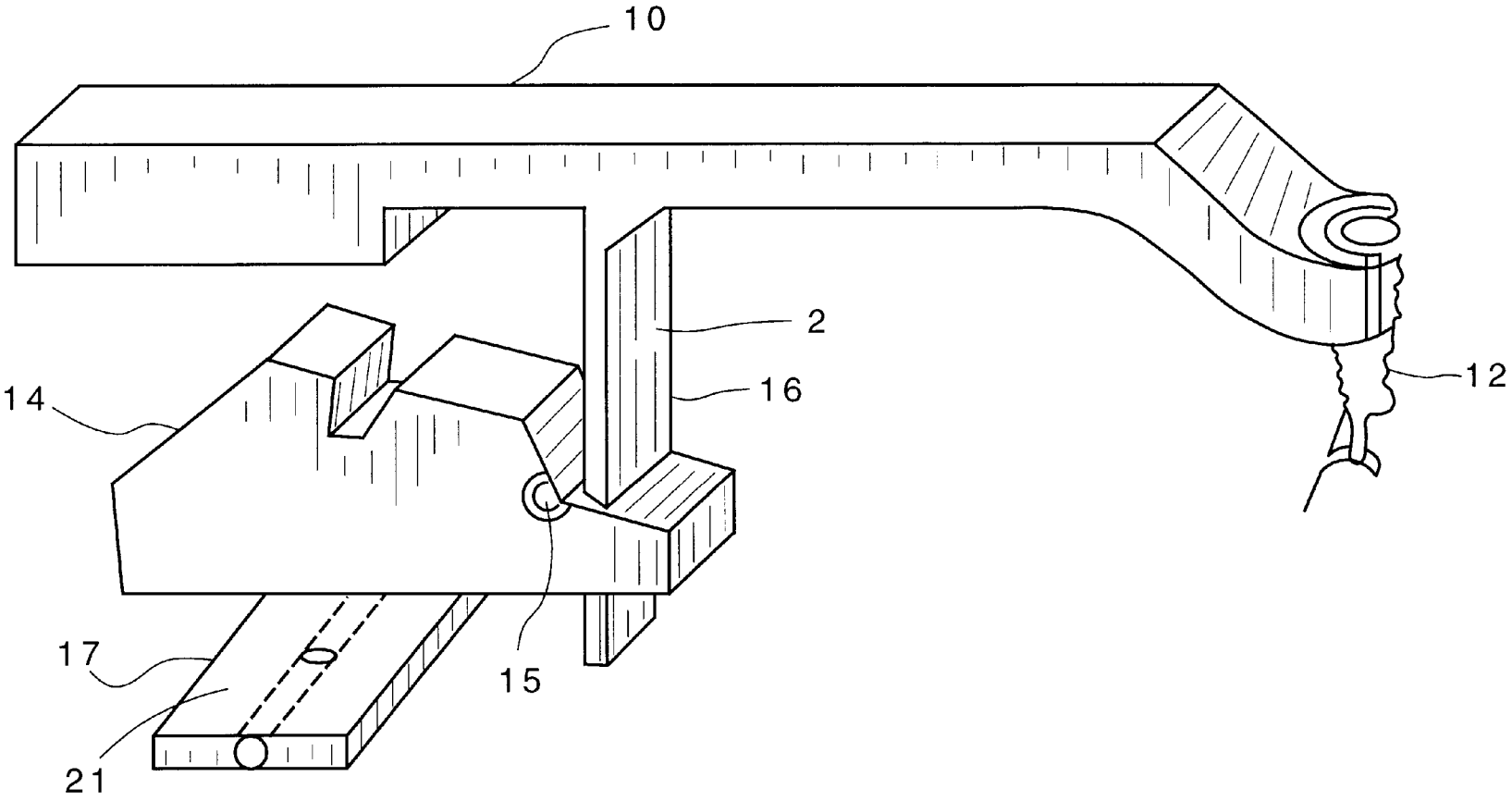
FIG. 2 is an isometric view thereof.
Figure 3:
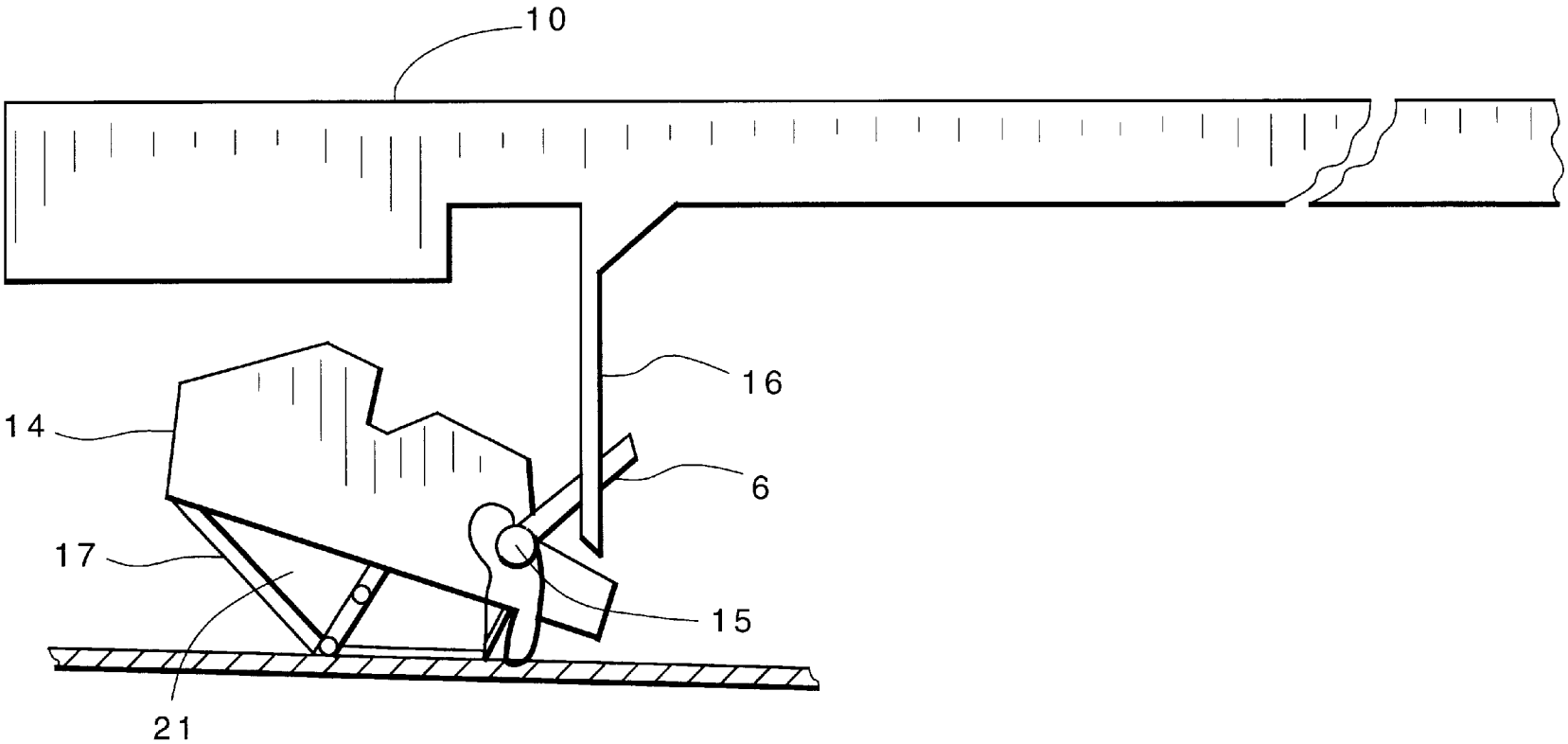
FIG. 3 is a side view with the key down.
Figure 4:
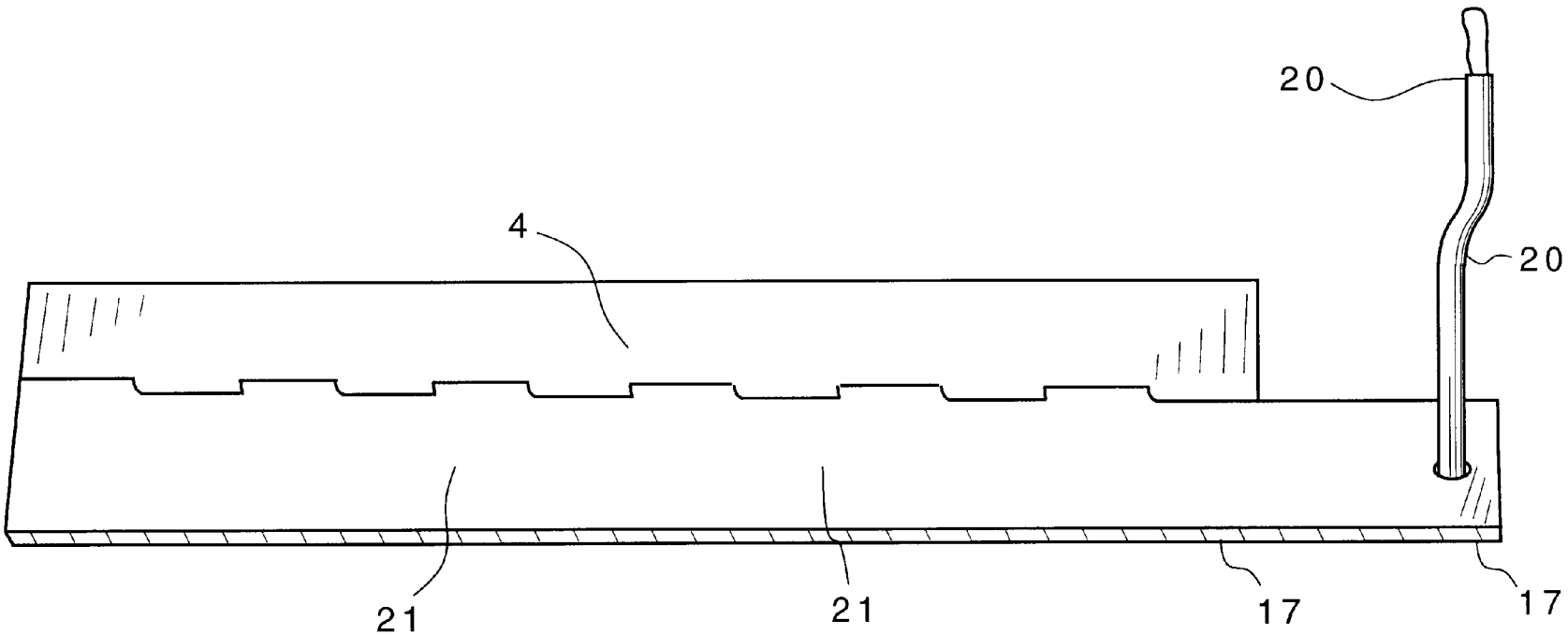
FIG. 4 is a perspective view of the one embodiment weight adjustment mechanism.

A weighted action musical electronic instrument (EM1) keyboard has a plurality of keys 10 and a common pivot point 11 for the keys and spring means 12 biasing each key to a uniform position. Each key 10 has an associated weight member 14 and a common fulcrum point 15 for each associated weight member 14. Each key 10 has a depending weight actuator member 16 engaging its associated weight member, respectively, such that when a key is depressed by a musician the "feel" to the musician is that of a given type of musical instrument. The invention provides a device for disabling the effect of at least some of the associated weight members 14 to thereby change the "feel" to the musician of the keyboard.

The device for disabling includes a bar member 17 pivotally mounted at 18 on the frame F of the keyboard. The bar member 17 is beneath all or some of the associated weight members 14. A mechanism, which may be a lever 20 (or a linkage or solenoid) is used for rotating the bar member 17 in a direction to pivot the associated weight members 14 about the common fulcrum point 18 and disengage the weight actuator members 16 from engagement with the associated weight member 14. Sound-deadening material 21, which may be sponge rubber is provided on the upper surface of bar member 17. Key actuation sensor strips 22 are mounted above or below the keys 10.

While the invention has been described in relation to preferred embodiments of the invention, it will be appreciated that other embodiments, adaptations and modifications of the invention will be apparent to those skilled in the art.

What is claimed is:

1. A weighted action musical instrument keyboard having a plurality of keys, a common pivot point for said keys and spring means biasing each key to a uniform position, each key having an associated weight member and a common fulcrum point for each associated weight member, and each key having a weight actuator member engaging its associated weight member, respectively, such that, when a key is depressed by a musician, the feel to the musician is that of a given type of musical instrument, an improvement comprising a device for disabling the effect of at least some of associated weight members to thereby change the feel to the musician of said keyboard.

2. The weighted keyboard defined in claim 1 wherein said device for disabling includes a bar member, pivot means mounting said bar member beneath said associated weight members and means for rotating said bar member in a direction to rotate said associated weight members about said common fulcrum point and disengage said weight actuator members from engagement with said associated weight member.

* * * * *